US009211571B1

(12) United States Patent
Knowlton

(10) Patent No.: US 9,211,571 B1
(45) Date of Patent: Dec. 15, 2015

(54) LINE SET SAVER

(71) Applicant: Bryan T. Knowlton, San Angelo, TX (US)

(72) Inventor: Bryan T. Knowlton, San Angelo, TX (US)

( * ) Notice: Subject to any disclaimer, the term of this patent is extended or adjusted under 35 U.S.C. 154(b) by 482 days.

(21) Appl. No.: 13/666,763

(22) Filed: Nov. 1, 2012

(51) Int. Cl.
*B08B 9/04* (2006.01)

(52) U.S. Cl.
CPC ..... *B08B 9/04* (2013.01)

(58) Field of Classification Search
CPC ..... B08B 9/04
See application file for complete search history.

(56) References Cited

U.S. PATENT DOCUMENTS 4,606,403 A * 8/1986 Fujimoto et al. ..... 165/95

* cited by examiner

*Primary Examiner* — Jason Ko
(74) *Attorney, Agent, or Firm* — Mark W Handley; Handley Law Firm, PLLC

(57) ABSTRACT

A line set saver (12) has a swab (60) with a wiper (66) for cleaning refrigeration suction and discharge lines. A gas injection port (34) and a line injection port (38) extend through the line set saver (12) to an injector (16) located on a forward end (30). A threaded hole (32) is provided on a rearward end of the gas injection port (34). The line injection port (38) extends from a first side (54) of the line set saver (12) to the gas injection port (34), and a line (42) extends from the first side (54), through the line injection port (38) and from the injector (16). A terminal end of the line (42) is secured to the swab (60). A reel (44) is pivotally mounted to the first side (54) of the line set saver (12) for spooling the line (42) relative to the line injection port (38).

20 Claims, 4 Drawing Sheets

LINE SET SAVER

TECHNICAL FIELD OF THE INVENTION

The present invention relates in general to refrigeration systems, and in particular to a tool for cleaning lubricants from suction and discharge line sets of refrigeration systems.

BACKGROUND OF THE INVENTION

Refrigeration systems have previously used prior art refrigerants formed of fluorocarbons and chlorofluorocarbons, but these refrigerants are being phased out because of their ozone depletion effects. More environmentally friendly refrigerants are being used in their place, such as those formed of difluoromethane. A problem has arisen in retrofitting older refrigeration and building air conditioning systems for use with the more environmentally friendly refrigerants due to lubricants used in the different refrigerants. The lubricants used in prior art refrigerants will coagulate when mixed with oils in the newer refrigerants, requiring that refrigerant suction and discharge line sets be replaced since the refrigerant lines cannot be cleaned of the residual lubricants used in prior refrigerants. The costs of replacing suction and discharge line sets in refrigeration systems and building air conditioning systems significantly raises the costs of replacing older refrigeration systems with newer energy efficient refrigeration systems.

SUMMARY OF THE INVENTION

A novel line set saver is disclosed having a swab for cleaning refrigeration suction and discharge lines. The line set saver has a gas injection port and a line injection port. The gas injection port extends from a threaded hole in a rearward end of the body of the line set saver to a forward end of the body. The line injection port extends from a first side of the body of the line set saver to a forward portion of the gas injection port, with the line injection port and the gas injection port intersecting at an acute angle which faces in a rearward direction. An injector extends from the forward end of the body and has a tapered periphery, and the gas injection port is in communication with a centrally disposed portion of the tapered periphery. A line extends from the first side of the body, through the line injection port and from the injector. A reel is pivotally mounted to the first side of the body for spooling the line relative to the line injection port. A line guide boss is disposed on one side of the body and configured in alignment with the line injection port and the reel. The swab is secured to a terminal end of the line forward of the injector. The swab has a wiper for interiorly engaging within the suction and discharge lines when the line is spooled from the line injection port and onto the reel. The wiper is preferably an annular-shaped protuberance which extends laterally around the swab body, with a forward end being tapered to narrow in a forward direction. The line set saver body further includes a storage cavity extending from a rearward end of the body, and a plug for securing in a rearward end of the storage cavity.

DESCRIPTION OF THE DRAWINGS

For a more complete understanding of the present invention and the advantages thereof, reference is now made to the following description taken in conjunction with the accompanying Drawings in which

FIG. 1 is a perspective view of the line set saver;

FIG. 2 is an exploded view of the line set saver;

FIG. 3 is a sectional view of the line set saver, taken along section line 3-3 of FIG. 1;

FIG. 4 is a perspective view of a swab of the line set saver;

FIG. 5 is sectional view of the swab, taken along section line 5-5 of FIG. 4; and FIG. 6 is a sectional view of a line set saver of an alternative embodiment, as would be viewed if taken along corresponding section line 3-3 of FIG. 1.

DETAILED DESCRIPTION OF THE INVENTION

Figure 1:
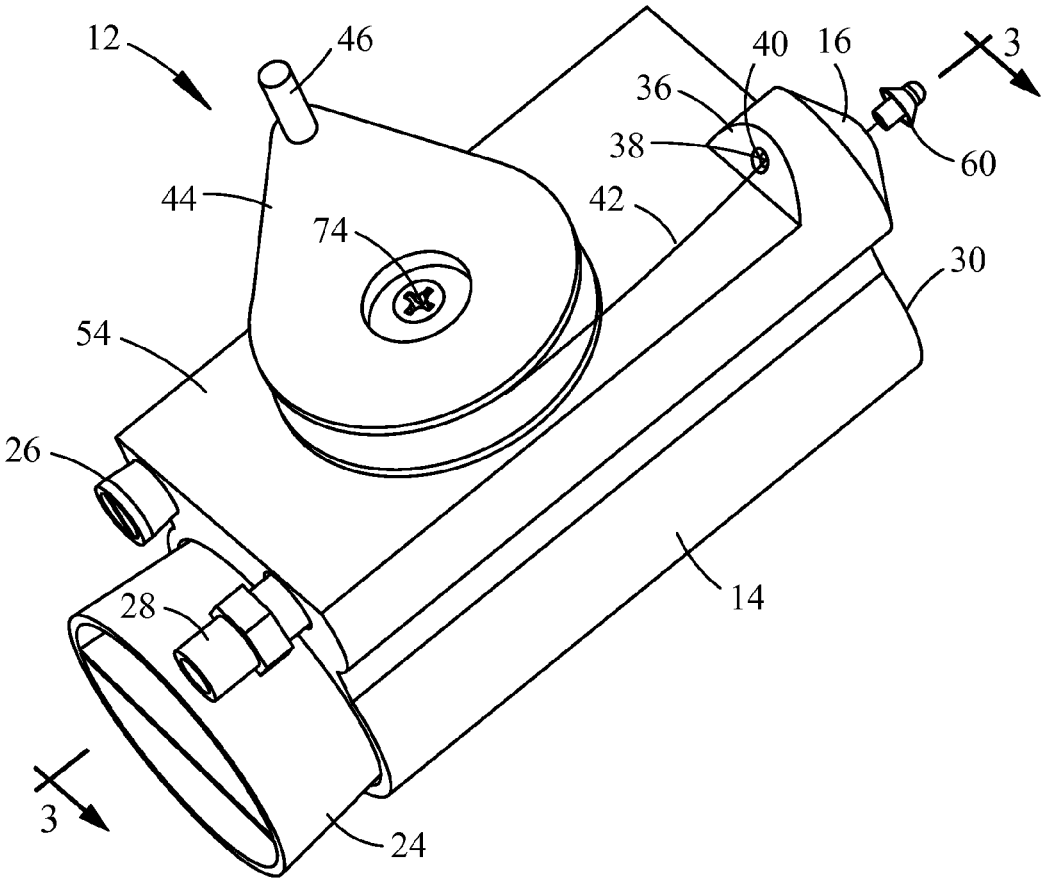
FIGS. 1 through 6 show various aspects for a line set saver made according to the present invention, as set forth below.
Figure 2:
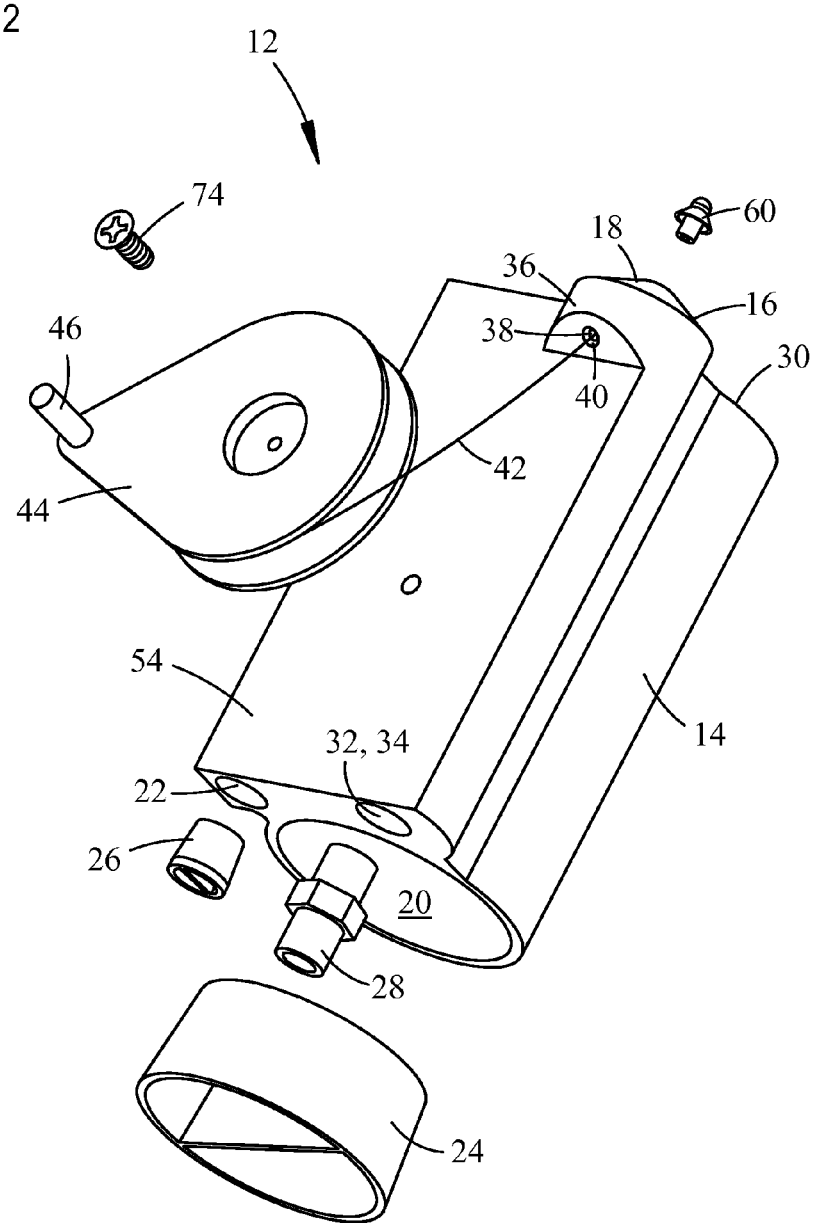

FIG. 1 is a perspective view and FIG. 2 is an exploded view of the line set saver 12. The line set saver 12 has a body 14. The body 14 has a forward end 30 from which an injector 16 extends. The injector 16 has a tapered periphery 18 defining a frusto conical shape. The body 14 has a first storage cavity 20 and a second storage cavity 22. Plugs 24 and 26 are provided for sealing the rearward ends of the storage cavities 20 and 22. A pipe nipple 28 is secured to a threaded hole 32 defined in a rearward end of a gas injection port 34. The gas injection port 34 extends longitudinally through the body 14. The nipple 28 and the threaded end 32 are preferably a nominal size of one-eight inch standard pipe thread. A line guide boss 36 extends laterally outward of a first side 54 of the body 14. A line injection port 38 extends into the body 14, preferably through the line guide boss 36. A tapered guide section 40 defines an entrance section of the line injection port 38 for passing a line 42 into the body 14. A reel 44 is pivotally mounted to the first side 54 of the body 14 for spooling the line 42. The reel 44 has handle 46 pivotally secured to the body 14 by a retaining screw 74. The line 42 extends through the line injection port 38 and into the body 14, then outward of the body 14 through the injector 16 and is connected to a swab 60. The swab 60 is secured to the forward terminal end of the line 42.

Figure 3:
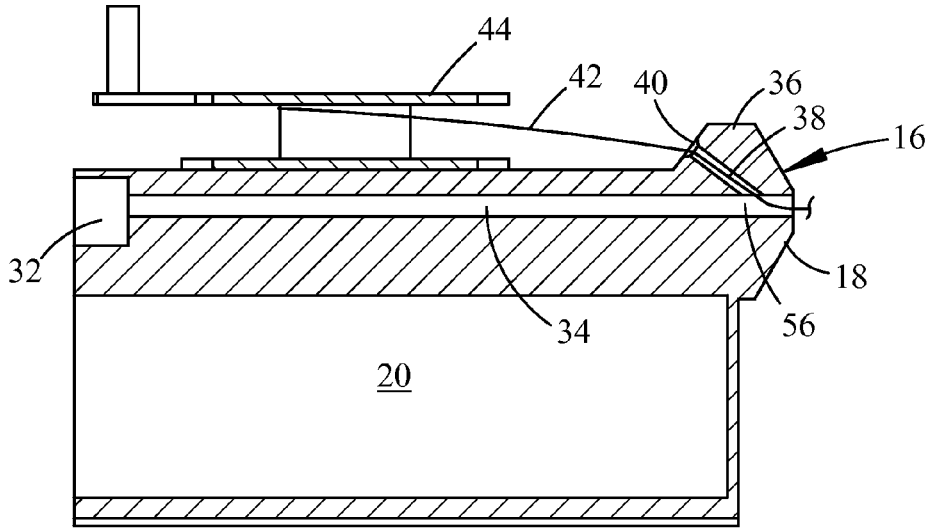

FIG. 3 is a sectional view of the line set saver 12, taken along section line 3-3 of FIG. 1. The gas injection port 34 extends from the threaded hole 32 in the rearward end of the body 14 through the injector 16 in the forward end 30 of the body 14. The line injection port 38 extends from the tapered guide section 40 to intersect with a forward section 56 of the gas injection port 34 providing communication there-between for passing the line 42 through the line injection port 38, into the forward section 56 of the gas injection port 34 and outward through the injector 16.

Figure 5:
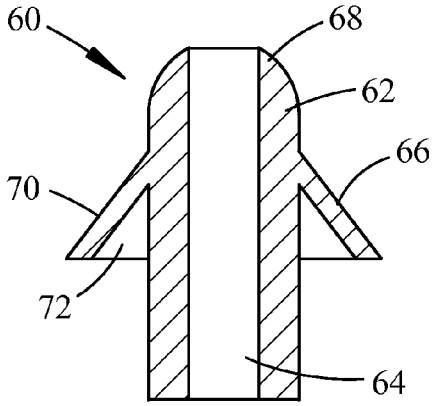
Figure 4:
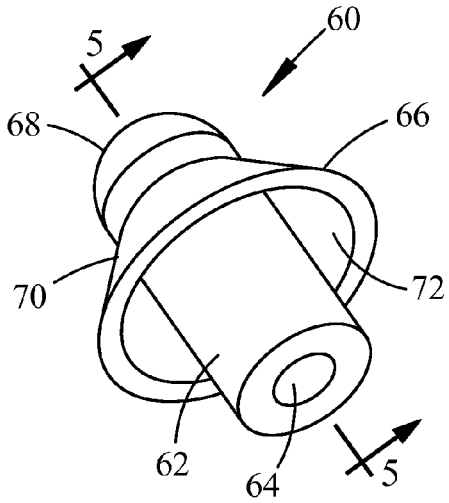

FIG. 4 is a perspective view of a swab 60, and FIG. 5 is a sectional view of the swab 60, taken along section line 5-5 of FIG. 4. The swab 60 preferably as a solid body 62 with a port 64 extending longitudinally through the solid body 62. A forward end of the solid body 62 has tip 68 which is preferably round to define a tapered end. A wiper 66 is formed to extend outward from a side of the solid body 62 with an annular shaped, tapered forward end 70 and defining a cavity 72 on a rearward side. The forward end 70 tapers to narrow, or have a smaller diameter, in extending in a forward direction. The wiper 66 is preferably flexible to allow the wiper 66 to collapse into the cavity 72 for insertion into refrigeration discharge and suction lines when moving in a forward direction under the force of gas, such as nitrogen, injected into the refrigeration lines through the gas injection port 34 and the injector 16, and then to expand and wipe the walls of the refrigeration lines when pulled outward in a rearward direction by means of the reel 44. Different sizes of swabs 60 will be used for refrigeration lines of various sized.

Figure 6:
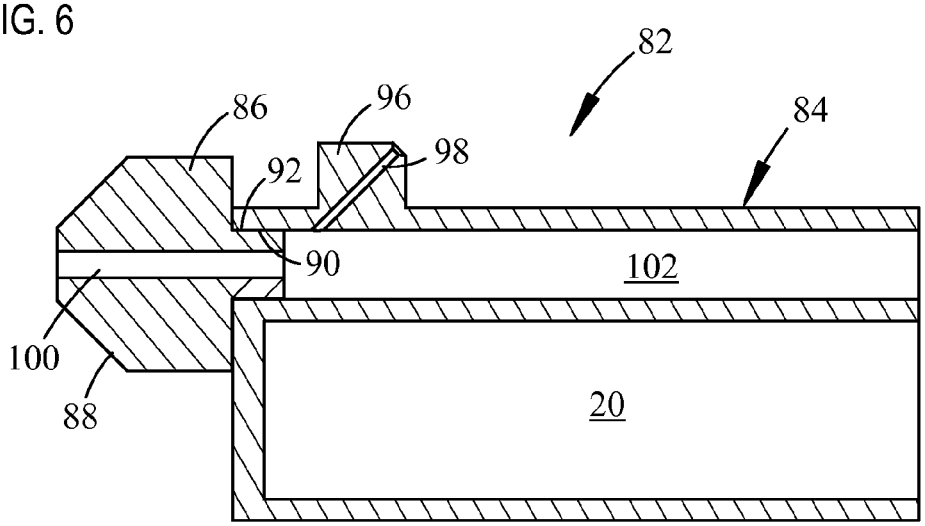

FIG. 6 is a sectional view of a line set saver 82 of an alternative embodiment, as would be viewed if taken along corresponding section line 3-3 of FIG. 1. The line set saver 82 has a body 84 and a detachable injector 86, which may be removed from the body 84. The detachable injector 86 has a tapered end 88 of frusto conical shape which corresponds to the tapered end 18 of the injector 16. The injector 86 has a rearwardly disposed end having a threaded male pipe connection 92 for threadlingly securing in sealing engagement with a threaded female port 90 formed in the forward end of a flow passage 102 passing through the body 84. A flow port 100 extends through the injector 86 for passing the line 44 and gas from the flow passage 102 and through the tapered end 88. The body 84 of the line set saver 82 further includes a line guide boss 96 which extends from a first side of the line set saver 82 and through which a line injection port 98 passes into the body 84 and intersects with the flow passage 102. The line 42 will pass through the line injection port 98 and into the flow passage 102 and then through the flow port 100 for passing through the injector 98 and into a line of a line set.

Preferably the body 12 and the reel 44 of the line set saver 12 will be formed of rigid plastic. The swab 60 is preferably formed of a plastic which will be flexible to allow collapse of the wiper 66 when moved in a forward direction, and expansion for wiping the walls of refrigeration lines when moved in a rearward direction. The line 42 may be a monofilament fishing line, or braided fishing line.

In operation, the line 44 is wound about the reel 40, passed through the line injection port 38, through the forward section 56 of the gas injection port 34, out the forward end of the injector 16, and then secured to the swab 60. The swab 60 is then inserted into a line of a line set with the tip 68 extending first into the line of the line set. A forward tip of the tapered end 18 of the injector 16 is pressed against the end of the line of the line set to seal there-between, and then gas is injected through the gas injection port, pushing the swab 60 into the line and taking the terminal end of the line 42 with the swab 60. Then, the gas is removed from the line set saver 12 and the line 42 is wound back onto the reel 44, pulling the swab 60 back through the line. The wiper 66 of the swab 60 will open and scrape against the interior wall of the line to clean the oil from the line.

The present invention provides advantages of tool which may be used to wipe refrigeration lubricants from the interior surfaces of suction and discharge line sets of refrigeration systems. This allows current refrigeration and building air conditioning systems to be retrofitted for use with newer, environmentally friendly refrigerants without requiring replacement of existing line sets.

Although the preferred embodiment has been described in detail, it should be understood that various changes, substitutions and alterations can be made therein without departing from the spirit and scope of the invention as defined by the appended claims.

What is claimed is:

1. A line set saver for use with refrigeration suction and discharge lines comprising:

a body having a gas injection port and a line injection port, said gas injection port extending from a threaded hole to a forward end of said body, and said line injection port extending from a first side of said body to a forward portion of said gas injection port;

an injector extending from said forward end of said body, said injector having a tapered periphery defining a forward end thereof, and gas injection port in communication with a centrally disposed portion of said tapered periphery;

a line extending from said first side of said body, through said line injection port and from said injector;

a reel pivotally secured to said first side of said body, said reel disposed aside of said line injection port for spooling said line relative to said line injection port; and a swab secured to said line forward of said injector, said swab defining a wiper for interiorly engaging within at least one of the suction and discharge lines when said line is spooled from said line injection port and onto said reel.

2. The line set saver according to claim 1, further comprising a line guide boss disposed on one side of said body and configured in alignment with said line injection port and said reel, such that said line extends from said reel and into said line injection port for moving there-between.

3. The line set saver according to claim 1, wherein said line injection port is formed to extend into said line guide boss.

4. The line set saver according to claim 1, wherein said swab has a solid body with a port extending longitudinally through said solid body for receiving said line.

5. The line set saver according to claim 1, wherein said swab has a solid body and said wiper is an annular shaped protuberance extending laterally around said solid body, with a forward end of said wiper being tapered to narrow in extending in a forward direction and a rearward end defining a cavity into which said wiper flexes when moved in a forward direction into the at least one of the suction and discharge lines.

6. The line set saver according to claim 1, wherein said body further comprises a first storage cavity extending from a rearward end of said body, and a plug for securing in an outwardly disposed end of said storage cavity.

7. The line set saver according to claim 1, wherein said line injection port and said gas injection port intersect at an acute angle facing in a rearward direction of said body.

8. The line set saver according to claim 1, wherein said injector is integrally formed with said body.

9. A line set saver for use with refrigeration suction and discharge lines comprising:

a body having a gas injection port and a line injection port, said gas injection port extending from a threaded hole to a forward end of said body, and said line injection port extending from a first side of said body to a forward portion of said gas injection port, wherein said line injection port and said gas injection port intersect at an acute angle facing in a rearward direction of said body;

an injector extending from said forward end of said body, said injector having a tapered periphery defining a forward end thereof, and gas injection port in communication with a centrally disposed portion of said tapered periphery;

a line extending from said first side of said body, through said line injection port and from said injector;

a reel pivotally secured to said first side of said body, said reel disposed aside of said line injection port for spooling said line relative to said line injection port;

a line guide boss disposed on one side of said body and configured in alignment with said line injection port and said reel, such that said line extends from said reel and into said line injection port for moving there-between; and a swab secured to said line forward of said injector, said swab defining a wiper for interiorly engaging within at least one of the suction and discharge lines when said line is spooled from said line injection port and onto said reel.

10. The line set saver according to claim 9, wherein said line injection port is formed to extend into said line guide boss.

11. The line set saver according to claim 9, wherein said swab has a solid body with a port extending longitudinally through said solid body for receiving said line.

12. The line set saver according to claim 9, wherein said swab has a solid body and said wiper is an annular shaped protuberance extending laterally around said solid body, with a forward end of said wiper being tapered to narrow in extending in a forward direction and a rearward end defining a cavity into which said wiper flexes when moved in a forward direction into the at least one of the suction and discharge lines.

13. The line set saver according to claim 9, wherein said body further comprises a first storage cavity extending from a rearward end of said body, and a plug for securing in an outwardly disposed end of said storage cavity.

14. The line set saver according to claim 9, wherein said injector is integrally formed with said body.

15. A line set saver for use with refrigeration suction and discharge lines comprising:

a body having a gas injection port and a line injection port, said gas injection port extending from a threaded hole to a forward end of said body, and said line injection port extending from a first side of said body to a forward portion of said gas injection port, wherein said line injection port and said gas injection port intersect at an acute angle facing in a rearward direction of said body;

an injector extending from said forward end of said body, said injector having a tapered periphery defining a forward end thereof, and gas injection port in communication with a centrally disposed portion of said tapered periphery;

a line extending from said first side of said body, through said line injection port and from said injector;

a reel pivotally secured to said first side of said body, said reel disposed aside of said line injection port for spooling said line relative to said line injection port;

a line guide boss disposed on one side of said body and configured in alignment with said line injection port and said reel, such that said line extends from said reel and into said line injection port for moving there-between;

a swab secured to a terminal end of said line forward of said injector, said swab defining a wiper for interiorly engaging within at least one of the suction and discharge lines when said line is spooled from said line injection port and onto said reel; and said swab having a swab body and said wiper defining is protuberance which extends laterally around said swab body, with a forward end of said wiper being tapered to narrow in extending in a forward direction.

16. The line set saver according to claim 15, wherein said line injection port is formed to extend into said line guide boss.

17. The line set saver according to claim 15, wherein said swab has a solid body with a port extending longitudinally through said solid body for receiving said line.

18. The line set saver according to claim 15, wherein said body further comprises a first storage cavity extending from a rearward end of said body, and a plug for securing in an outwardly disposed end of said storage cavity.

19. The line set saver according to claim 15, wherein said injector is integrally formed with said body.

20. The line set saver according to claim 15, wherein said injector is separately formed from said body, and is removable and replaceable.

* * * * *